US005667199A

United States Patent [19]

Hamm

[11] Patent Number: 5,667,199

[45] Date of Patent: Sep. 16, 1997

[54] RAILING MADE OF PREFABRICATED STANDARD COMPONENTS

[76] Inventor: Wilfried Hamm, Im Wiesengrund 28, D-45481 Mühlheim/Ruhr, Germany

[21] Appl. No.: 406,957

[22] PCT Filed: Sep. 28, 1993

[86] PCT No.: PCT/EP93/02640

§ 371 Date: Mar. 24, 1995

§ 102(e) Date: Mar. 24, 1995

[87] PCT Pub. No.: WO94/08109

PCT Pub. Date: Apr. 14, 1994

[30] Foreign Application Priority Data

Sep. 30, 1992 [DE] Germany ..... 42 32 800.4

[51] Int. Cl.[6] ..... E04F 11/18

[52] U.S. Cl. ..... 256/65; 256/59; 256/69; 52/182

[58] Field of Search ..... 256/59, 65, 24, 256/60, 67, 68, 69, 21, 22; 52/182, 187

[56] References Cited

U.S. PATENT DOCUMENTS

| | | | |
|---|---|---|---|
| 699,809 | 5/1902 | Finnegan | 256/67 |
| 1,316,155 | 9/1919 | Harrison et al. | 256/65 |
| 2,117,798 | 5/1938 | Gascoigne et al. | 256/21 X |
| 2,859,990 | 11/1958 | Derrig | 256/65 |
| 3,342,457 | 9/1967 | Bobrowski | 256/65 X |
| 4,053,140 | 10/1977 | Clemens et al. | 256/66 X |
| 4,103,874 | 8/1978 | Horgan, Jr. | 256/24 |
| 4,881,351 | 11/1989 | Hamm | 52/182 |
| 5,230,500 | 7/1993 | Lin | 256/22 X |

FOREIGN PATENT DOCUMENTS

| | | | |
|---|---|---|---|
| 615470 | 2/1961 | Canada | 256/24 |
| 0 191 708 | 8/1986 | European Pat. Off. . | |
| 279202 | 8/1988 | European Pat. Off. | 52/182 |
| 21 50 050 | 4/1973 | Germany . | |
| 2334068 | 1/1975 | Germany | 52/182 |
| 90 06 311.2 | 8/1990 | Germany . | |
| 521 628 | 1/1946 | United Kingdom . | |

*Primary Examiner*—Harry C. Kim
*Attorney, Agent, or Firm*—Herbert Dubno

[57] ABSTRACT

A railing made of prefabricated standard components with railing rods, connecting elements between the railing rods and with railing panels. Each of the railing rods consists of a longitudinal part which can be secured to the building body, as well as a bent short end. The short end of the railing rods can be inserted longitudinally slidable into the connecting elements. The longitudinal part of each railing rod to be mounted is held in a transverse throughbore of the connecting element. The connecting elements are designed as handrail segments which have a blind bore in longitudinal direction for receiving the short end of a railing rod and transversely thereto a throughbore for the vertical longitudinal part of the railing rod to be mounted. Further on the longitudinal part of the railing rods panel holders are adjustably arranged for fastening the railing panel.

9 Claims, 10 Drawing Sheets

RAILING MADE OF PREFABRICATED STANDARD COMPONENTS

CROSS REFERENCE TO RELATED APPLICATIONS

This application is a national phase of PCT/EP93/02640 filed 28 Sep. 1993 and based, in turn, upon German national application P42 32 800.4 filed 30 Sep. 1992 under the International Convention.

FIELD OF THE INVENTION

The invention relates to a railing made of prefabricated standard components, with railing rods, connecting elements between the railing rods and the railing panel. The railing rods consist of a longitudinal part which can be fastened to the building body, as well as of a short bent end which can be inserted slidingly in the longitudinal direction into the connecting elements and the longitudinal part is retained in a transverse opening of the connecting element.

BACKGROUND OF THE INVENTION

In the railing known from DE-U 90 06 311, which represents the starting point of the invention, the railing panel is connected on the one side to the bent short end and on the other side to the longitudinal part of the same railing rod. By the interposition of connecting elements the prefabricated components can be assembled into a railing. The bannister consists of the bent segments of the railing rods, each of them being detachably connected at its free end with the next railing rod by one of the connecting elements. Such a bannister is not satisfactory from the aesthetic point of view. The handle strength of the regular bannister which is built like a bar with a round or square cross section is normally perceived as insufficient. A free configuration of the railing is also not possible, a fact which limits the use of the railing in more demanding construction projects.

OBJECT OF THE INVENTION

It is the object of the invention to provide an improved railing consisting of a few prefabricated standard components and offering the possibility to have a bannister which does not depend on the railing rods with regard to material configuration and also enables free selection of the railing panel.

SUMMARY OF THE INVENTION

In order to achieve this object the invention teaches that the connecting elements be handrail segments having a blind bore in the longitudinal direction for receiving the short end of a railing rod and a transverse throughbore for the vertical longitudinal part of the railing rod to be mounted. On the longitudinal part of the railing rod panel holders for fastening the railing panel are adjustably arranged. A railing made according to the teaching of the invention consists of the following standard components, whose dimensions are coordinated modularly: railing rods, handrail segments and railing panels. The handrail segments extend over the distance between the railing rods mounted to the building body. It is sufficient to arrange the handrail segments with a certain length and at a preselected stepping with respect to each other. Since the bent short end of the railing rods is longitudinally adjustable in a blind bore of the handrail segment, during assembly they adjust to the local conditions. The selection of the material, handle strength, design and color does not depend on the railing rods. Handrail pieces made of rare wood or of plastic can be used. Considerable possibilities of configuration are offered. Due to the free configuration of the handrail segments it is possible to bridge greater distances between the railing rods. The fastening of the railing rods in the handrail segments is suitably done by means of locking screws which are inserted in the handrail segments and arranged so that they are covered by the latter. The railing panels are connected to the longitudinal part of the railing rods and are longitudinally slidable on the rods for the sake of orientation. The panel holders provided for the fastening of the panels have each an advantageous annular connection piece with a spherically curved outer surface which can be attached to the railing rods and contains a radial threaded bore with locking screw.

The configuration of the railing panel as an independent part can be freely selected. According to a first embodiment the railing panel consists of a tube or several tubes welded to each other as well as of two horizontal tube-connecting ends and the panel holders are provided with connection sleeves for receiving the tube-connecting ends. The railing rods which are manufactured with excessive length can be easily adjusted at the construction site by sawing. After that they are inserted in the connection sleeves and can be fixed by a locking screw. An alternate embodiment provides for a glass connecting piece screwed onto the panel holder and having a guide slot for receiving a plate, preferably of glass or an acrylic glass. According to a third and preferred embodiment of the invention the rail panel has at least one tube-like crossbar which can be stuck onto connection pins of the panel holder and slide thereon, whereby the crossbar contains at least one transverse throughbore wherein a panel rod can be vertically inserted, and whereby the crossbar is further equipped with locking screws for securing the panel rod and for fastening the crossbar to the connection pins.

The mounting of the railing rods to the building body can be done in various ways. A preferred embodiment of the invention has the railing rods inserted at their lower ends in two vertically superposed annular holders and secured by a locking screw inserted in the threaded bores of the annular holders. The annular holders are screwed onto threaded pins of a mounting plate provided at the building body and can be adjusted on these pins for fitting purposes and that the mounting plate has horizontal as well as vertical oblong holes traversed by fastening screws, by means of which it can be aligned on the building body. The described mounting arrangement makes possible a particularly easy assembly and a very accurate vertical orientation of the railing rods in all directions in space. Further it is possible to adjust and correct the railing height in a simple manner. Suitably the panel holders and/or the annular holders are annealed cast-iron components.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
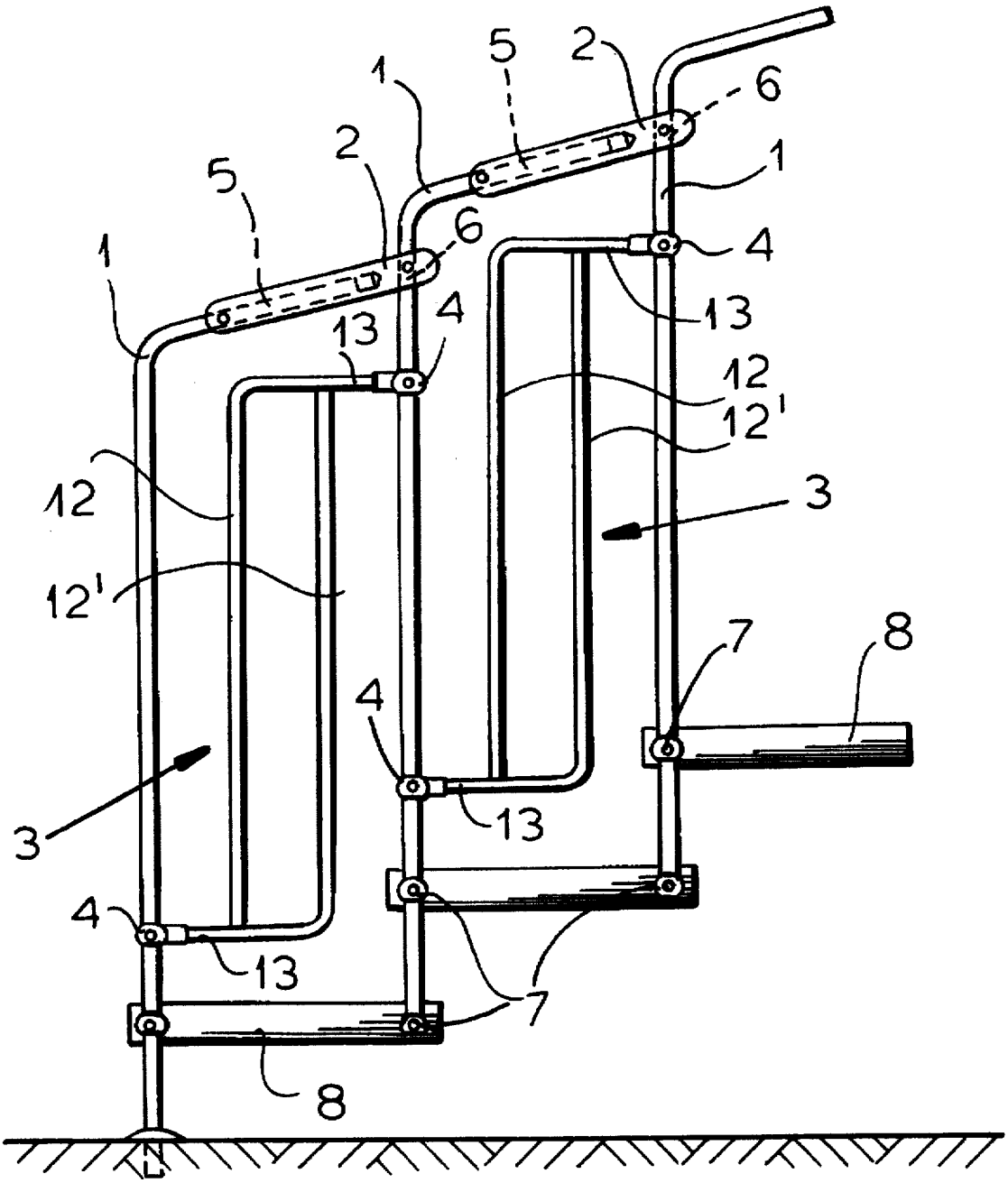
FIG. 1 is a side view of a railing made of prefabricated standard components.
Figure 3:
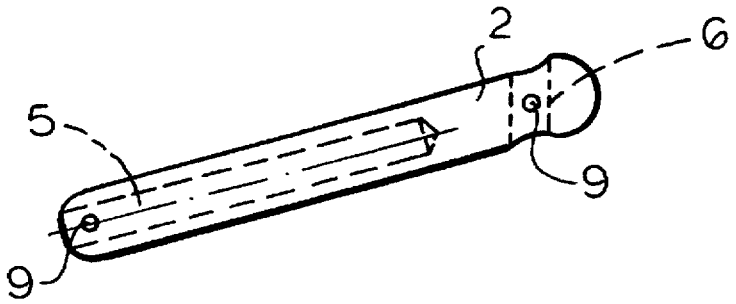
FIG. 3 is an elevational view of a handrail segment for the railing shown in FIGS. 1 and 2, in an enlarged representation.

For the mounting of the railing shown in FIG. 1 to outside stairs it is necessary to have railing rods 1, handrail segments 2, railing panels 3 and panel holders 4 for fastening the railing panels 3. The railing rods 1 each are of a tubular profile bent at one end, for whose universal applicability it is merely required to provide a few variations of the angular position of the short end. The short end of the railing rod 1 is longitudinally slidable in an axially running bore 5 of the respective handrail segment, while the long end of the railing rod 1 is guided in a transverse through-going bore 6 of the preceding handrail segment 2. Together with the lower fastening element 7 mounted to the building body 8 the arrangement forms continuous successions of frames. The arrangement is horizontally adjustable through the axial bore 5 of the handrail segment 2 and vertically adjustable over the throughbore 6 of the handrail segments, and as indicated in the Figures it can be secured by means of locking screws 9 (FIG. 3) built into the handrail segments 2.

The panel holders 4 for fastening the railing panel 3 are adjustably arranged on the longitudinal parts of railing rods 1. Especially from FIGS. 11 to 15 it can be seen that the panel holders 4 have each an annular connection piece 10 with a spherically curved outer surface, which can be slipped onto the longitudinal part of railing rods 1. Besides the annular connection piece 10 contains a radial threaded bore 11 for a locking screw not shown in the drawing. The panel holders 4 with the described connection pieces 10 can also be briefly defined as ball mountings.

Figure 2:
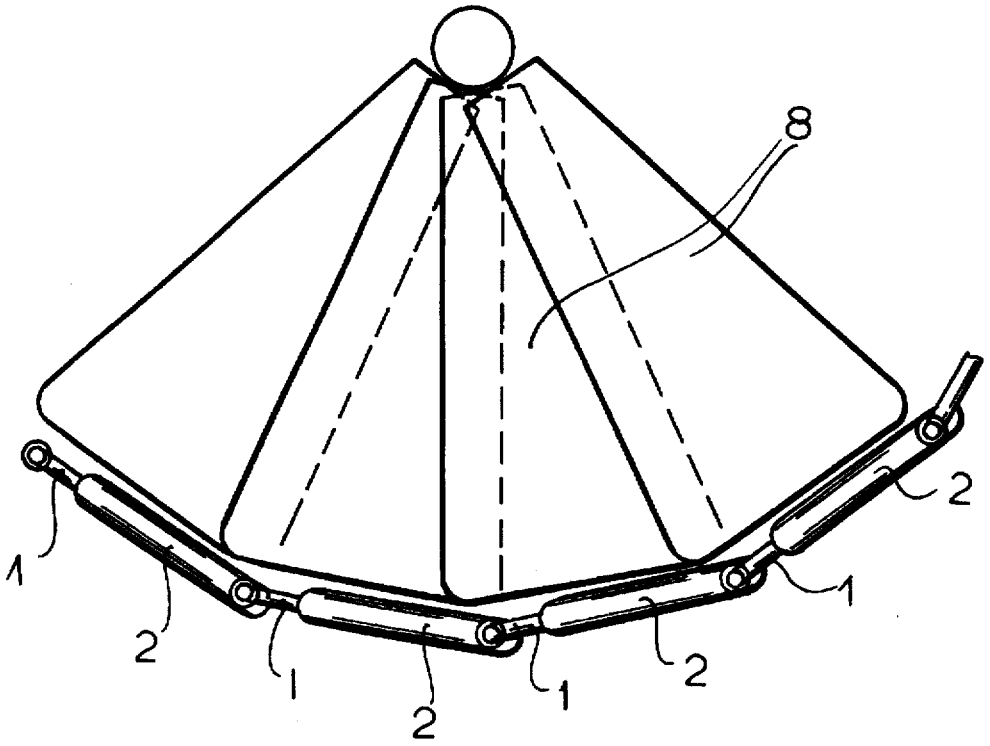
FIG. 2 is a top view of the railing of FIG. 1.
Figure 5:
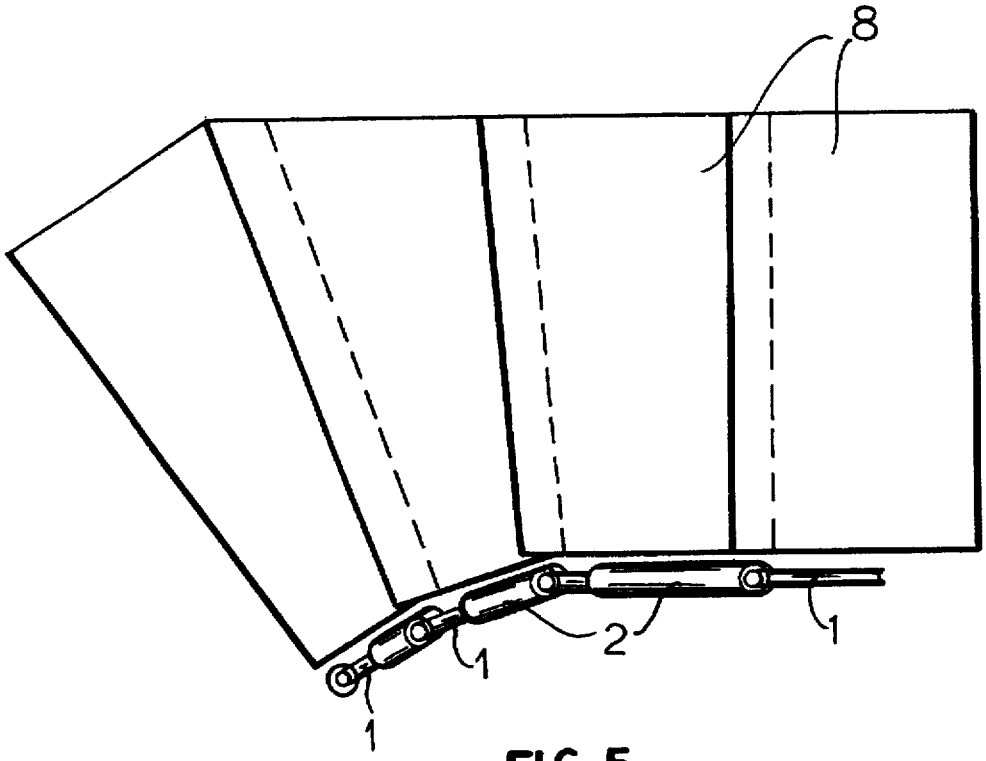
FIGS. 4 and 5 are a side view and a top view of a further embodiment of the rail of the invention.
Figure 11:
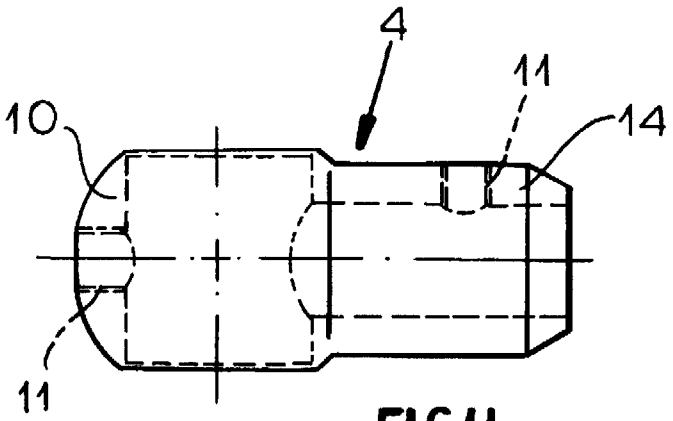
FIGS. 11 and 12 are a side view and a top view of a panel holder for the fastening of the railing panel shown in FIGS. 1 and 4.
Figure 12:
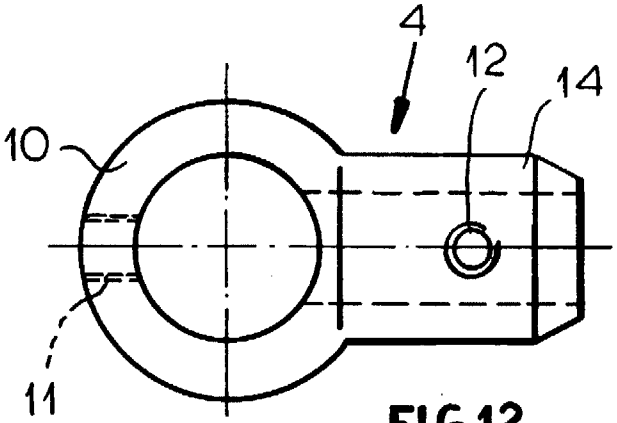

In the railings shown in FIGS. 1 and 2, as well as 4 and 5 the railing panel 3 is built of a tube 12 or several tubes 12, 12' welded to each other. The railing panel 3 has two horizontal tube-connecting ends 13. The panel holders 4 are equipped with connection sleeves 14 for receiving the tube-connecting ends 13 (FIGS. 11 and 12). The tube-connecting ends 13 have excessive length and can be sawed off to the correct size at the construction site. After that the tube-connecting ends 13 are inserted into the connection sleeves 14 of the panel holders 4 and secured by a locking screw. The panel holders 4 are slidable along the railing rods 1 and can be secured by means of locking screws.

Figure 6:
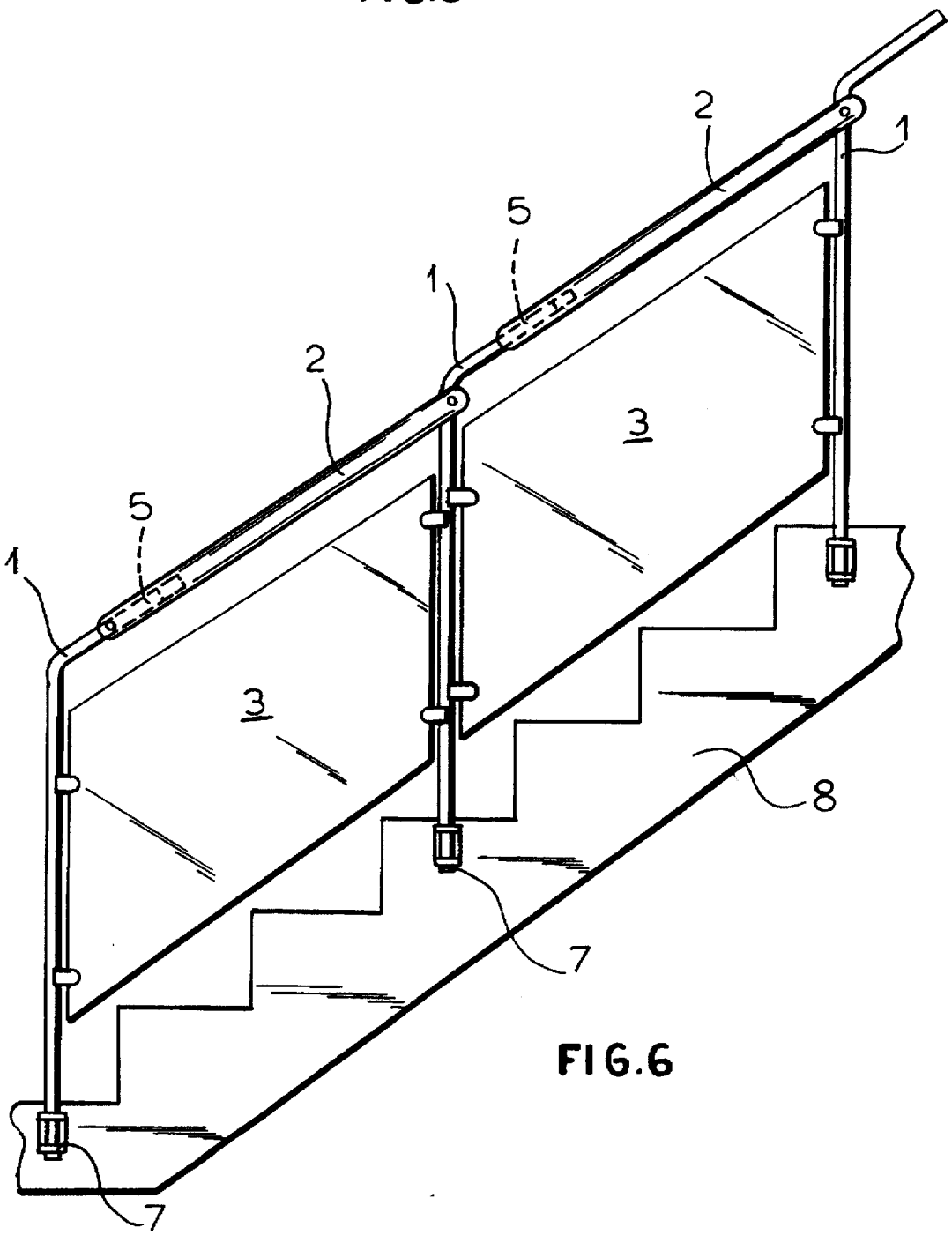
FIGS. 6 to 10 are side views of further embodiments of the railing of the invention.
Figure 8:
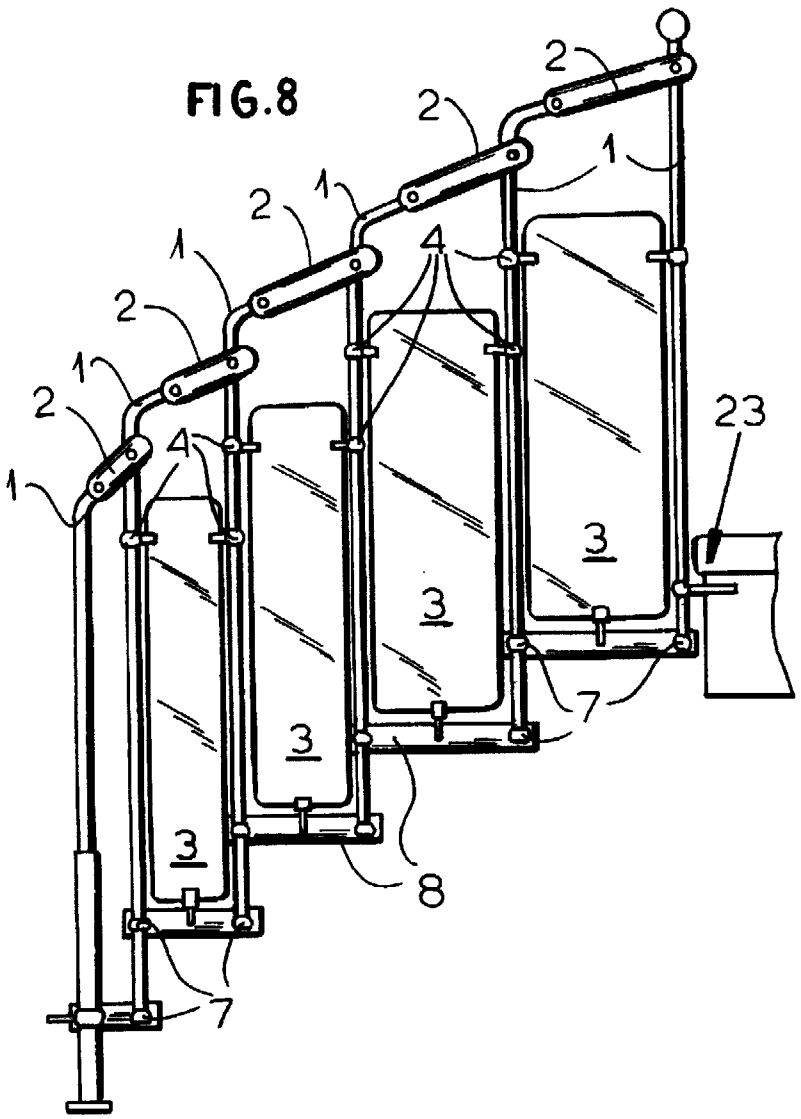
Figure 4:
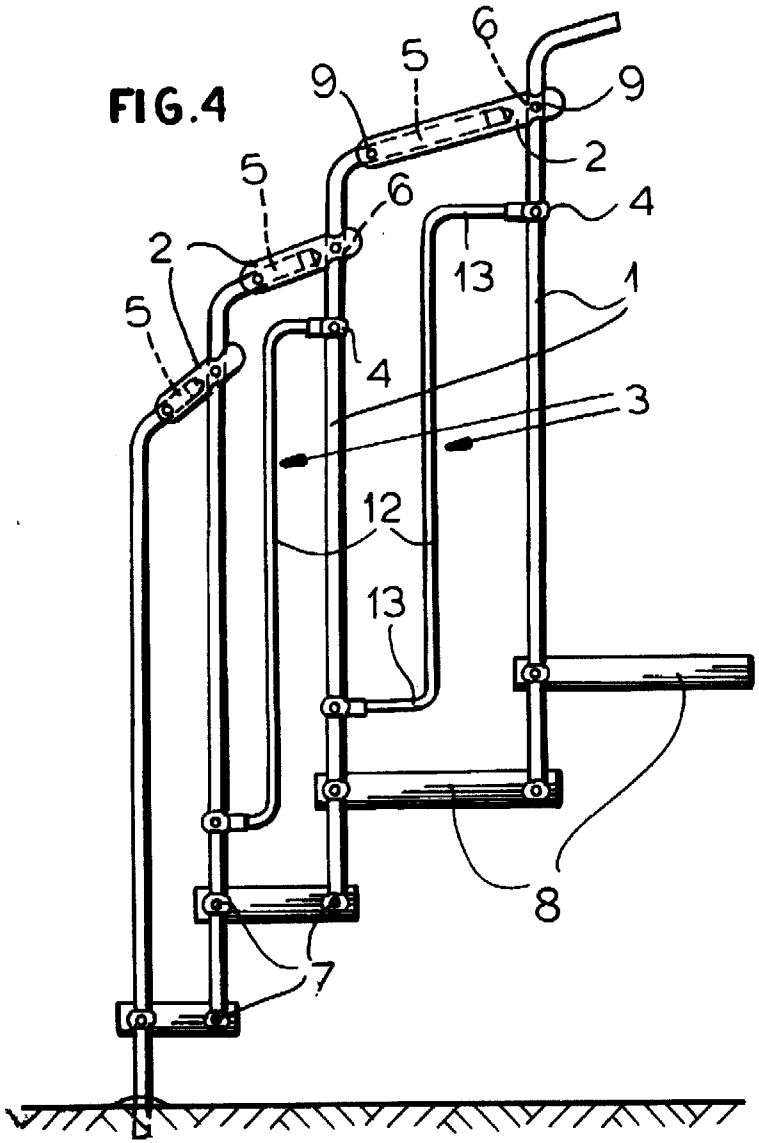
Figure 7:
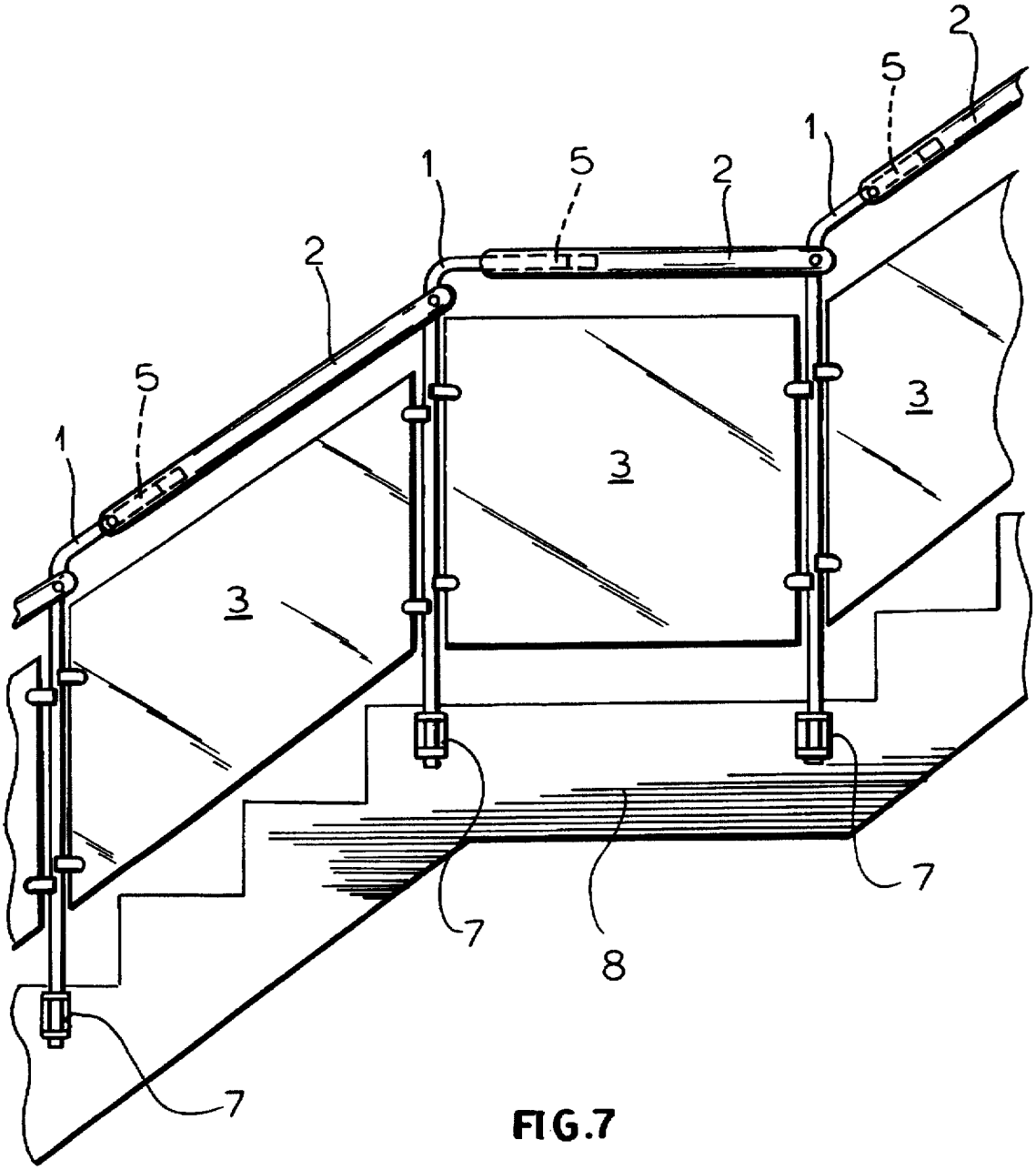
Figure 13:
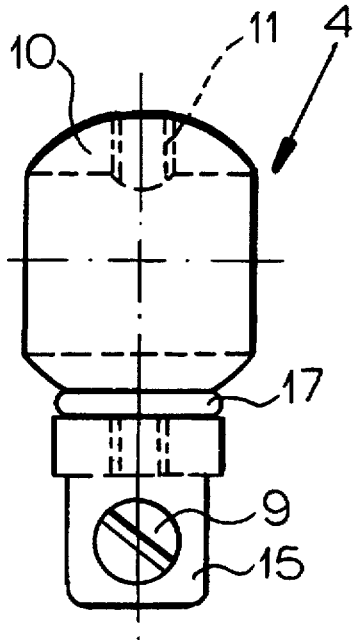
FIGS. 13 and 14 are a side view and a top view of a panel holder for railing panels made of glass or acrylic.
Figure 14:
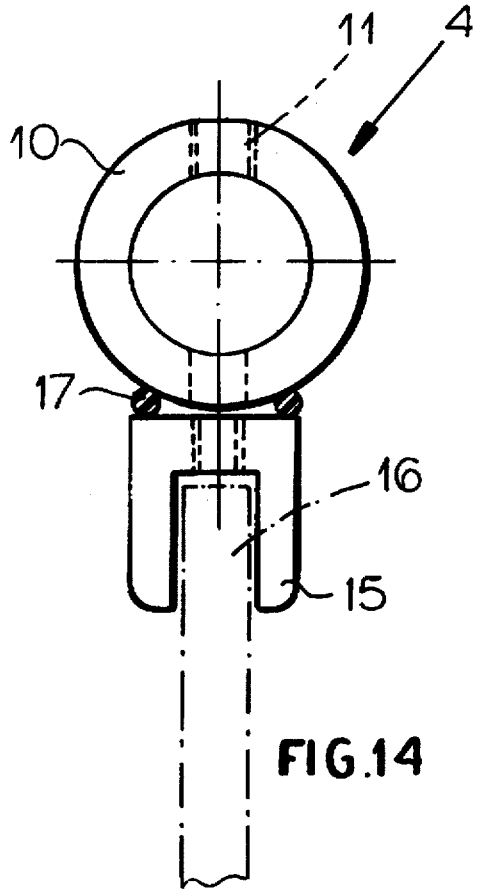
Figure 15:
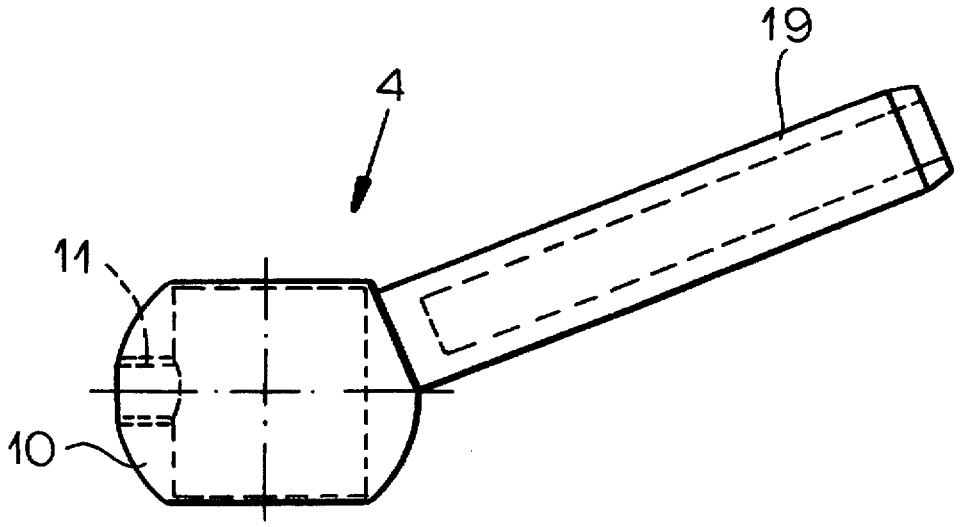
FIG. 15 is an elevational view of a panel holder for fastening a railing panel in the embodiment of FIG. 9.

FIGS. 6 to 8 are drawn to railings with railing panels 3 consisting of a plate made of glass or acrylic glass. The railing panel is connected to the longitudinal parts of the railing rods 1. It can also be fastened at its lower edge to the building body 8, for instance the steps of a staircase, as shown in FIG. 8. The panel holders 4 have the already described annular connection piece 10, to which a glass connection piece 15 with a guide slot 16 is screwed for receiving the glass or acrylic plate (FIGS. 13 and 14). Between the two parts 10, 15 of the panel holder 4 an elastomer ring 17 is provided in the embodiment.

Figure 9:
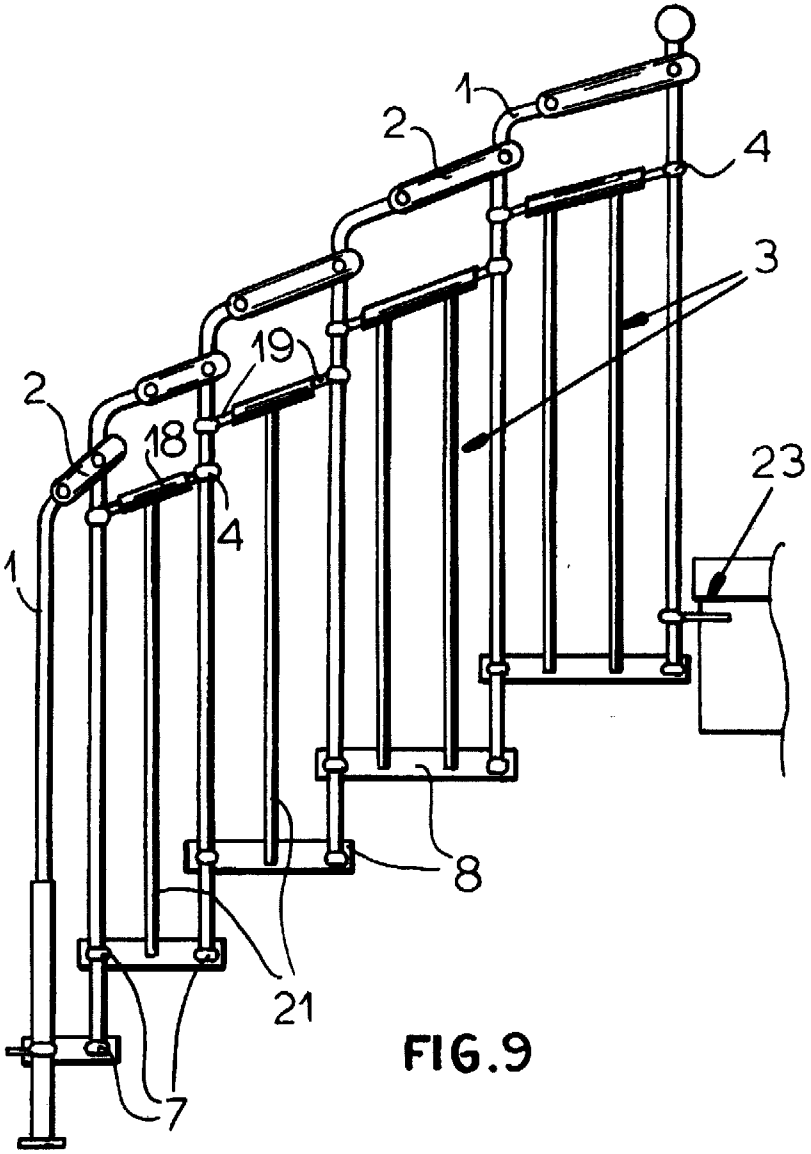
Figure 10:
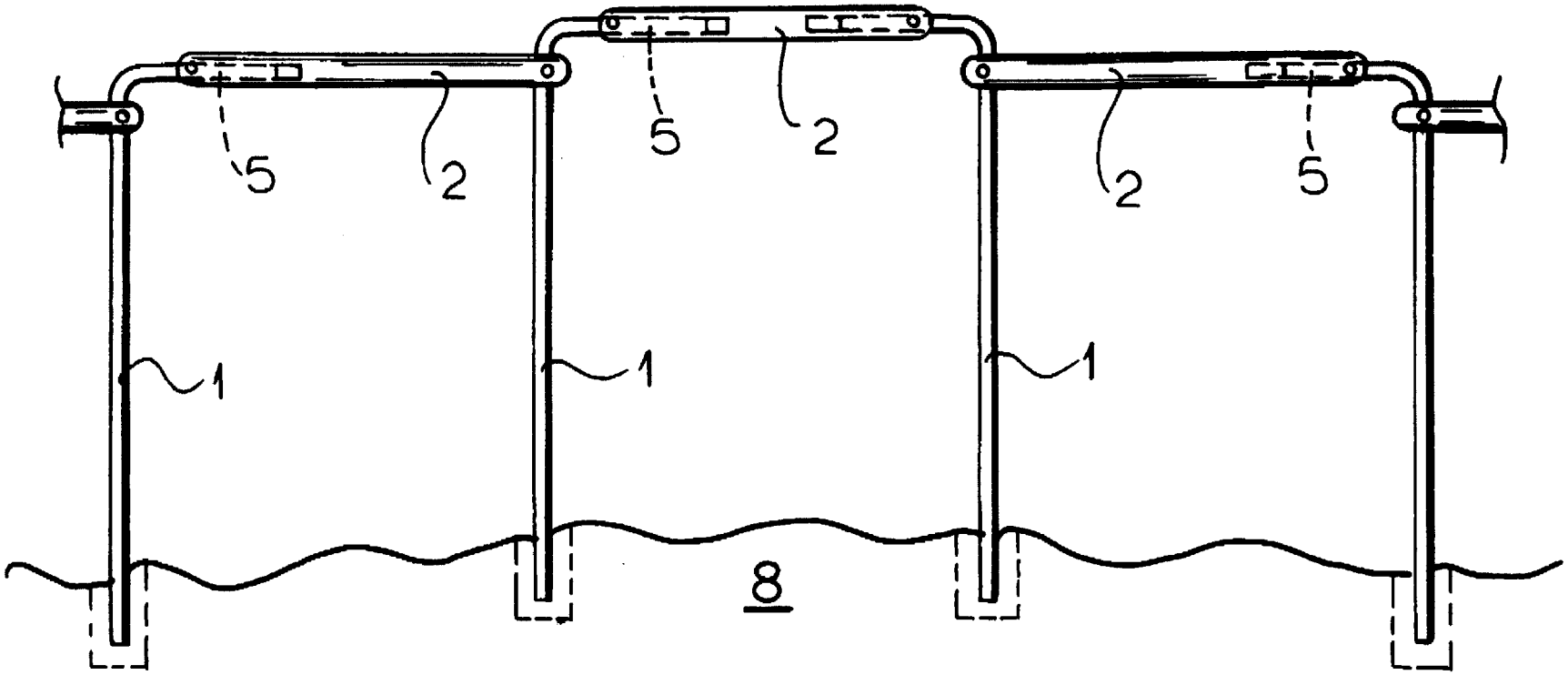
Figure 16:
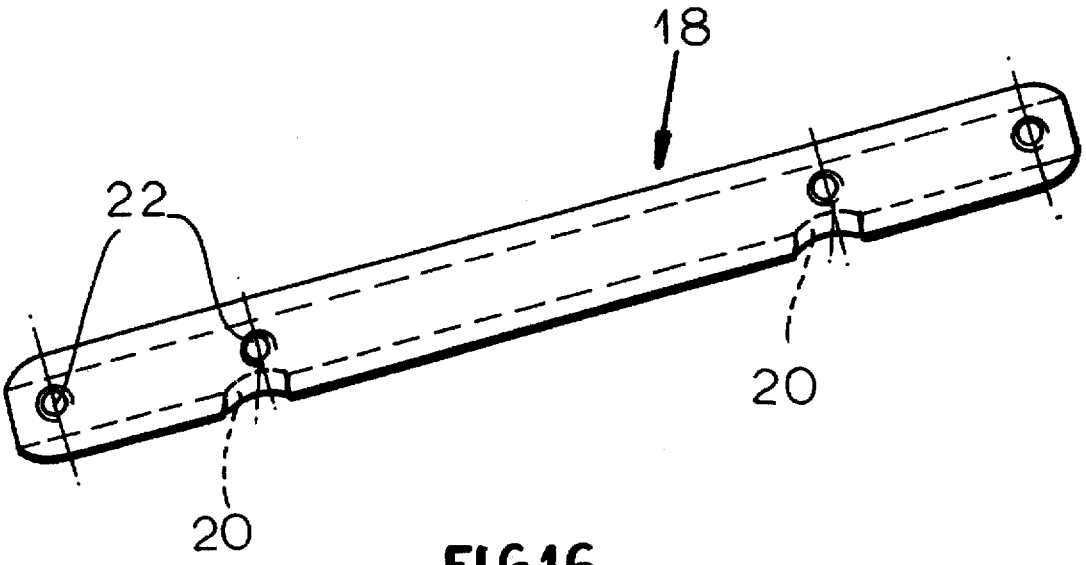
FIG. 16 is an elevational view of a crossbar for a railing panel in the embodiment of FIG. 9.

In the railing shown in FIG. 9 the railing panel 3 has at least one crossbar 18, which can be stuck onto connection pins 19 of the panel holders 4 and can slide thereon. By comparing FIGS. 9 and 16 it results that the crossbar 18 contains transverse throughbores 20, wherein panel rods 21 can be vertically inserted. Besides the crossbar 18 contains threaded bores 22 with locking screws for securing the panel rods 21 and for fastening the crossbar on the connection pins 19 of panel holders 4. The configuration of the panel holders 4 can be seen especially in FIG. 15. On the underside the vertical panel rods 21 are bent in this embodiment example and directly connected to the step. However it is also possible within the framework of the invention to insert the panel rods 21 in a bottom crossbar which is connected to the railing rods 1 in the previously described manner.

Figure 17:
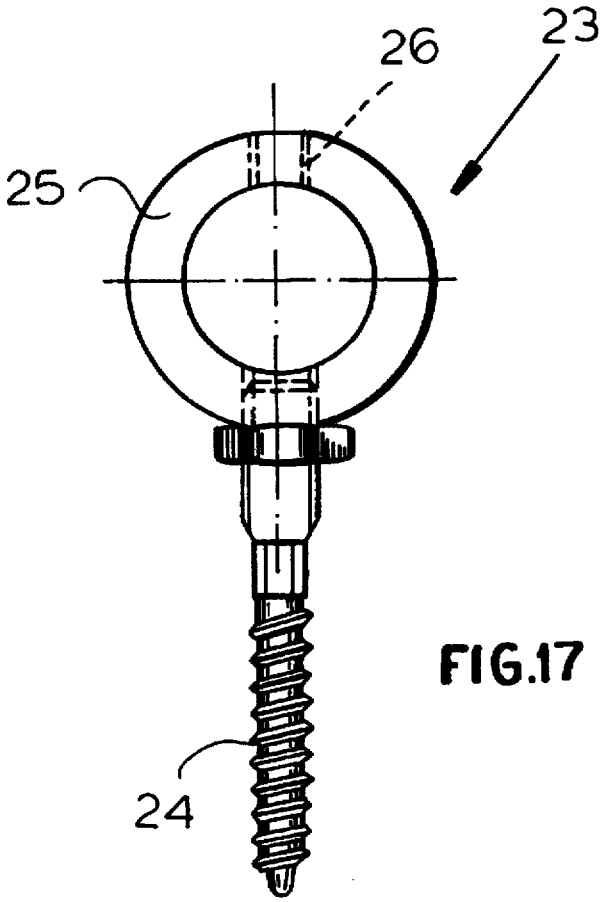
FIG. 17 is an elevational view of a holder for fastening the railing rods on outside stairs.

In a railing for outside stairs the steps can be connected to the railing rods by means of the holder 23 shown in a top view in FIG. 17. The holder 23 has a pin 24 which can be screwed into the steps, as well as an annular connecting element 25, which can be attached on the vertical longitudinal part of the railing rods 1. The annular connecting element 25 can be secured in the previously described manner by at least one locking screw, which can be inserted in a threaded bore 26 of the connecting element.

Figure 19:
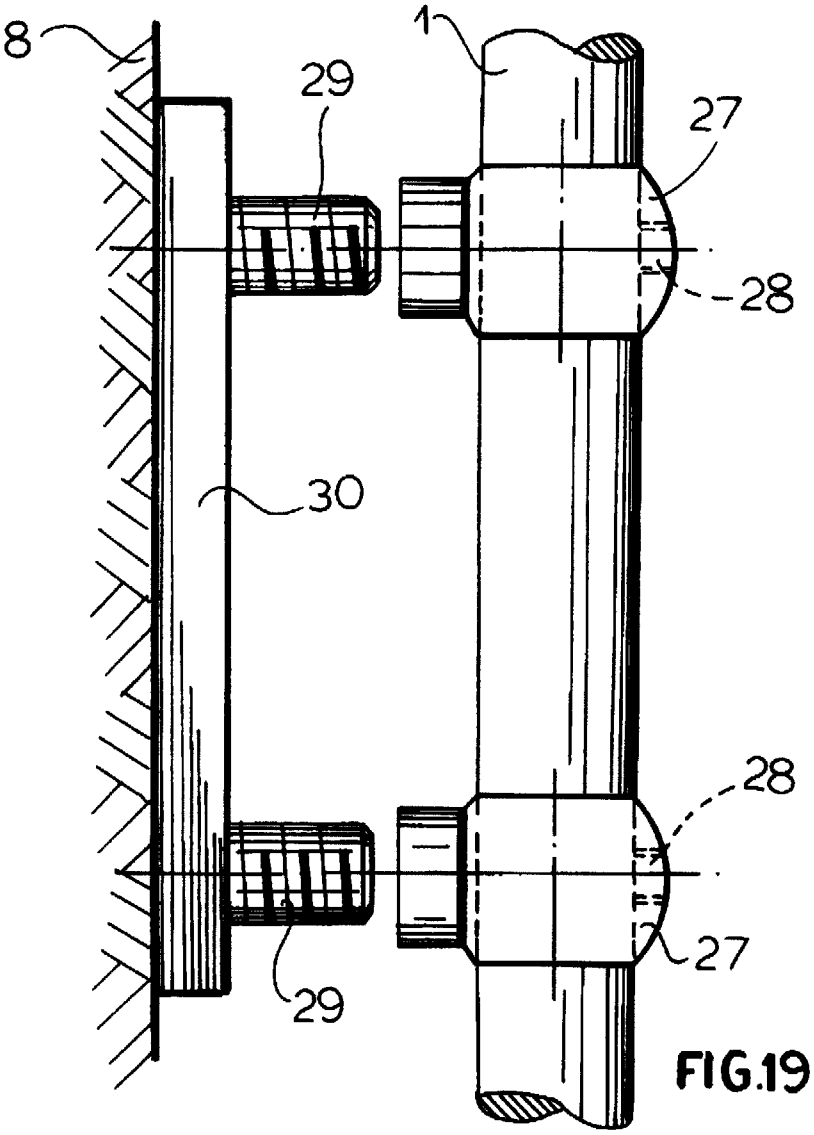
FIG. 19 is a top view of the mounting plate shown in FIG. 18.
Figure 18:
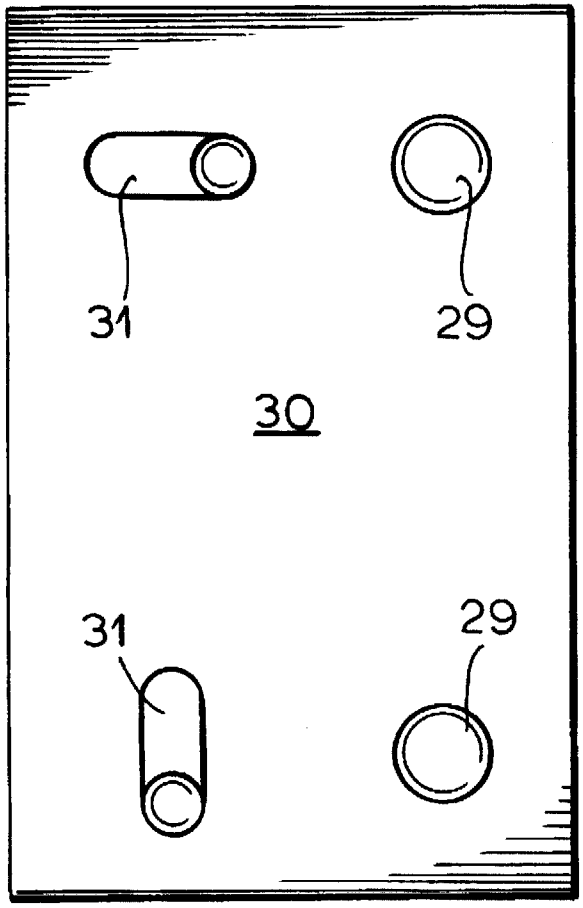
FIG. 18 is a side view of a mounting arrangement with a mounting plate for fastening the railing rods to concrete stairs.

In order to mount the railing rods to a concrete step it is advantageous to use the mounting arrangement shown in FIGS. 18 and 19. Each of the railing rods 1 is introduced with its lower end in two vertically superimposed annular holders 27 and secured by means of locking screws 28 threaded into the threaded bores of the annular holders 27. The annular holders 27 are screwed onto threaded pins 29 of a mounting plate 30 arranged on the building body and are adjustable on these pins for fitting purposes. Due to the described arrangement the vertical rods can be precisely set in a vertical position.

Panel holders 4 and annular holders 23, 27 are annealed cast components.

The horizontal and vertical adjustability of the described standard components, combined with a few different embodiments of the railing rods 1, as well as a suitable design of the handrail segments 2, whose transverse throughbores 6 have to have the same angular position, and a few various executions of the handrail segments represent the features which are decisive for any desired design of the railing. For instance in this way the step height and width of the stairs can be easily accommodated by the railing with its adjustment possibilities.

The few standard components 1 to 4 are the basis for an economical mass production. Further due to the arrangement of the invention it is possible to eliminate the usual preparatory determination of measurements, as well as assembly operations in the manufacturing plant. A simple assembly from the bottom to the top is possible. In the same design intermediate or landing platforms can be bridged. Regarding the design selection a great variety is offered. Due to the fact that on site any welding or other heat-related operations are avoided, railing rod coatings of all kind can be applied in advance, and this even in large-scale production. It is also possible to have a variety of designs for the handrail segments 2 (rare woods, plastic, metal). The modular standard components 1 to 4 offer an entire selection of possible configurations, which allow for a wide range of individual architectural designs.

I claim:

1. A railing mounted on a building structure, comprising:

a plurality of prefabricated standard substantially identical transversely spaced upright railing rods having relatively long shanks secured to said structure and bent relatively short upper ends on said shanks;

respective prefabricated standard and substantially identical connecting elements forming handrail segments each connecting one of said upper ends to the shank of a next railing rod, each of said handrail segments having a longitudinally extending blind bore opening at one extremity of the respective handrail segment and slidably receiving a respective short upper end, and a transverse throughgoing bore at an opposite extremity of each handrail segment slidably receiving a shank of the respective next railing rod; and respective prefabricated standard connecting panels each received between two of said railing rods and connected to the shanks thereof, said handrail segments having lengths substantially corresponding to a width of said connecting panels and bridging a spacing between successive railing rods and corresponding to said width, each of said shanks being received in two annular holders threaded onto pins in a mounting plate affixed to said structure and each of said annular holders having a threaded bore receiving a screw locking the respective holder onto the respective shank.

2. The railing defined in claim 1, further comprising locking screws on said hand rail segments engaging said upper ends and said shanks for securing said handrail segment thereto.

3. The railing defined in claim 1 wherein each of said panels has an annular connecting element surrounding a respective shank of the railing rods between which said panel is received, and each of said annular elements is provided with a radial threaded bore receiving a locking screw engageable with the respective shank.

4. The railing defined in claim 1 wherein each of said panels comprises a plurality of tubes welded to one another and two horizontal tubes connecting ends formed with connection sleeves and provided with panel holders attaching the panel to the shanks of two of said railing rods between which the respective panel is received.

5. The railing defined in claim 1 wherein each of said panels comprises means receiving a respective plate of glass or acrylic connected to respective panel holders engaging the shanks of two of said railing rods between which the respective panel is received.

6. The railing defined in claim 1 wherein each of said railing panels has at least one tubular cross bar engaged with connecting pins of panel holders.

7. The railing defined in claim 1 wherein said panels are secured on said shanks by cast annealed panel holders.

8. The railing defined in claim 1 wherein said shanks are held on said structure by cast annealed holders.

9. A railing mounted on a building structure, comprising:

a plurality of prefabricated standard substantially identical transversely spaced upright railing rods having relatively long shanks secured to said structure, and bent relatively short upper ends on said shanks;

respective prefabricated standard and substantially identical connecting elements forming handrail segments each connecting one of said upper ends to the shank of a next railing rod, each of said handrail segments having a longitudinally extending blind bore opening at one extremity of the respective handrail segment and slidably receiving a respective short upper end, and a transverse throughgoing bore at an opposite extremity of each handrail segment slidably receiving a shank of the respective next railing rod;

respective prefabricated standard connecting panels each received between two of said railing rods and connected to the shanks thereof, said handrail segments having lengths substantially corresponding to a width of said connecting panels and bridging a spacing between successive railing rods and corresponding to said width;

a respective mounting plate on said structure for each of said shanks;

a pair of welded pins projecting from each mounting plate;

a respective annular holder threaded onto each of said pins and receiving the shank of the respective railing rod whereby two of said holders receive each shank each of said holders having a locking screw engaging the respective shank; and means including vertical and horizontal oblong holes traversed by respective screws and formed in said locking plates for mounting said locking plates on said structure.

* * * * *